US010598397B2

(12) United States Patent
Kagawa et al.

(10) Patent No.: US 10,598,397 B2
(45) Date of Patent: Mar. 24, 2020

(54) VENTILATION FAN

(71) Applicant: MITSUBISHI ELECTRIC CORPORATION, Chiyoda-ku, Tokyo (JP)

(72) Inventors: Yoshihiro Kagawa, Tokyo (JP); Hidetoshi Yamato, Tokyo (JP); Daisuke Kobayashi, Tokyo (JP); Hiromitsu Yamauchi, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 264 days.

(21) Appl. No.: 15/558,391

(22) PCT Filed: Apr. 27, 2015

(86) PCT No.: PCT/JP2015/062747
§ 371 (c)(1),
(2) Date: Sep. 14, 2017

(87) PCT Pub. No.: WO2016/174721
PCT Pub. Date: Nov. 3, 2016

(65) Prior Publication Data

US 2018/0058709 A1 Mar. 1, 2018

(51) Int. Cl.
*F24F 7/013* (2006.01)
*F04D 25/06* (2006.01)
(Continued)

(52) U.S. Cl.
CPC ..... *F24F 7/013* (2013.01); *F04D 25/068* (2013.01); *F04D 25/14* (2013.01); *F04D 29/522* (2013.01); *F04D 29/545* (2013.01); *F24F 13/14* (2013.01)

(58) Field of Classification Search
CPC ..... F24F 7/013; F24F 13/14; F04D 25/068; F04D 25/14; F04D 29/552; F04D 29/545
(Continued)

(56) References Cited

FOREIGN PATENT DOCUMENTS

JP 05-036224 U 5/1993
JP 2000-121118 A 4/2000
(Continued)

OTHER PUBLICATIONS

International Search Report (PCT/ISA/210) dated Aug. 4, 2015, by the Japanese Patent Office as the International Searching Authority for International Application No. PCT/JP2015/062747.
(Continued)

*Primary Examiner* — Steven B McAllister
*Assistant Examiner* — Allen R Schult
(74) *Attorney, Agent, or Firm* — Buchanan Ingersoll & Rooney PC

(57) ABSTRACT

A ventilation fan includes: first and second electronic components attached to a back surface of a flange; a third electronic component including a claw portion on an outer portion of the third electronic component and attached to the back surface of the flange; internal wiring routed on the back surface of the flange and connecting the first and second electronic components; and a retention portion including: a first rib protruding from the back surface of the flange in a perpendicular direction to the back surface of the flange; and a second rib protruding from a side face of the first rib in a direction parallel with the plane direction of the back surface of the flange or protruding toward the back surface of the flange, the retention portion retaining the internal wiring between the undersurface of the second rib and the back surface of the flange.

4 Claims, 8 Drawing Sheets

(51) Int. Cl.

| | |
|---|---|
| ***F04D 25/14*** | (2006.01) |
| ***F04D 29/52*** | (2006.01) |
| ***F04D 29/54*** | (2006.01) |
| ***F24F 13/14*** | (2006.01) |

(58) Field of Classification Search
USPC ..... 454/333
See application file for complete search history.

(56) References Cited

FOREIGN PATENT DOCUMENTS

| | | | | |
|---|---|---|---|---|
| JP | 2000-310435 | A | | 11/2000 |
| JP | 2006-250434 | A | | 9/2006 |
| JP | 2008-232488 | A | | 10/2008 |
| JP | 2012-112614 | A | | 6/2012 |
| JP | 2014-006025 | A | | 1/2014 |
| JP | 2014-016048 | A | | 1/2014 |
| JP | 2014006021 | A | * | 1/2014 |

OTHER PUBLICATIONS

Written Opinion (PCT/ISA/237) dated Aug. 4, 2015, by the Japanese Patent Office as the International Searching Authority for International Application No. PCT/JP2015/062747.

* cited by examiner

VENTILATION FAN

FIELD

The present invention relates to a ventilation fan that is installed in an attachment portion of a wall, a ceiling, or the like of a building from the indoor side, and draws in indoor air and discharges it to the outdoors through an air passageway.

BACKGROUND

Ventilation fans that are installed in an attachment portion of a wall, a ceiling, or the like of a building by insertion from the interior side into an air passageway, such as a pipe or a duct, which provides communication between the inside and outside of a room, and that discharge air in the room to the outside for ventilation are known. Such ventilation fans include a cylindrical air channel to be inserted into the air passageway and a fan that includes a propeller-type impeller that rotates in the air channel. A flange extending in the radial direction is placed on the outer circumference of an interior-side opening portion of the cylindrical air channel. Some models of such ventilation fans include a shutter that opens and closes under the control of an electric motor in accordance with whether the product is being operated or stopped.

Internal wiring, such as electric wires for an electric motor, placed inside a ventilation fan is, in general, retained by ribs placed on the back surface of the flange perpendicularly to the back surface or fixed by screws, cord clips, or the like. When such internal wiring is fixed only by ribs placed perpendicularly to the back surface of the flange, the internal wiring tends to become loose, which hinders wiring work during the assembly of the product. If a wiring area in which the internal wiring is routed is to be covered, the internal wiring may be caught when a cover is attached. Thus, a countermeasure to prevent the internal wiring from becoming loose, such as use of an additional component to temporarily fix the wiring, may increase the manufacturing costs.

In response to such a problem, Patent Literature 1 discloses a ventilation fan in which a power cord is held by a pair of holding members with the power cord placed in groove-like portions of the holding members and then the holding members are fitted to a support segment by engaging the sides of the holding members, which are opposite the groove-like portions, with a groove in the support segment, thereby retaining the power cord.

CITATION LIST

Patent Literature

Patent Literature 1: Japanese Patent Application Laid-Open No. 2000-121118

SUMMARY

Technical Problem

The conventional technique described above requires the holding members for holding the electric wire in addition to the support segment placed on the back surface of the flange, which increases the manufacturing costs. Additionally, the holding members are small in size and thus require management of the components to prevent their loss from shipping to installation of the product at the installation site. Hence, work or a structure to manage the holding members is needed, thereby increasing the manufacturing costs.

The present invention has been achieved in view of the above, and an object of the present invention is to provide a ventilation fan that can prevent internal wiring from becoming loose with a simple structure and at low cost.

Solution to Problem

In order to solve the above problems and achieve the object, an aspect of the present invention is a ventilation fan that is attached to an attachment portion in a room and comprises: a cylindrical air channel; a main body frame that includes a flange connected to a circumferential edge portion of an inlet port of the air channel at a front face side of the air channel and extending in a radial direction, and a rising portion connected to an edge of the flange and protruding toward a back face side; and a fan including an impeller that rotates in the air channel. The ventilation fan comprises: a first electronic component and a second electronic component that are attached to a back surface of the flange; a third electronic component that includes a claw portion on an outer portion of the third electronic component and is attached to the back surface of the flange; an internal wiring routed on the back surface of the flange and connecting the first electronic component and the second electronic component; and a retention portion that includes a first rib protruding from the back surface of the flange in a perpendicular direction to a plane direction of the back surface of the flange, and a second rib protruding from a side face of the first rib in a direction parallel with the plane direction of the back surface of the flange or protruding toward the back surface of the flange, the retention portion retaining the internal wiring between an undersurface of the second rib and the back surface of the flange. The retention portion has an attachment hole for attaching the claw portion in an upper region of the first rib with respect to the second rib, and the claw portion is inserted into the attachment hole to retain the third electronic component.

Advantageous Effects of Invention

The present invention produces an effect of providing a ventilation fan that can prevent internal wiring from becoming loose with a simple structure and at low cost.

DESCRIPTION OF EMBODIMENTS

A ventilation fan according to exemplary embodiments of the present invention will now be described in detail with reference to the drawings. The present invention is not limited to the embodiments.

Embodiment

Figure 1:
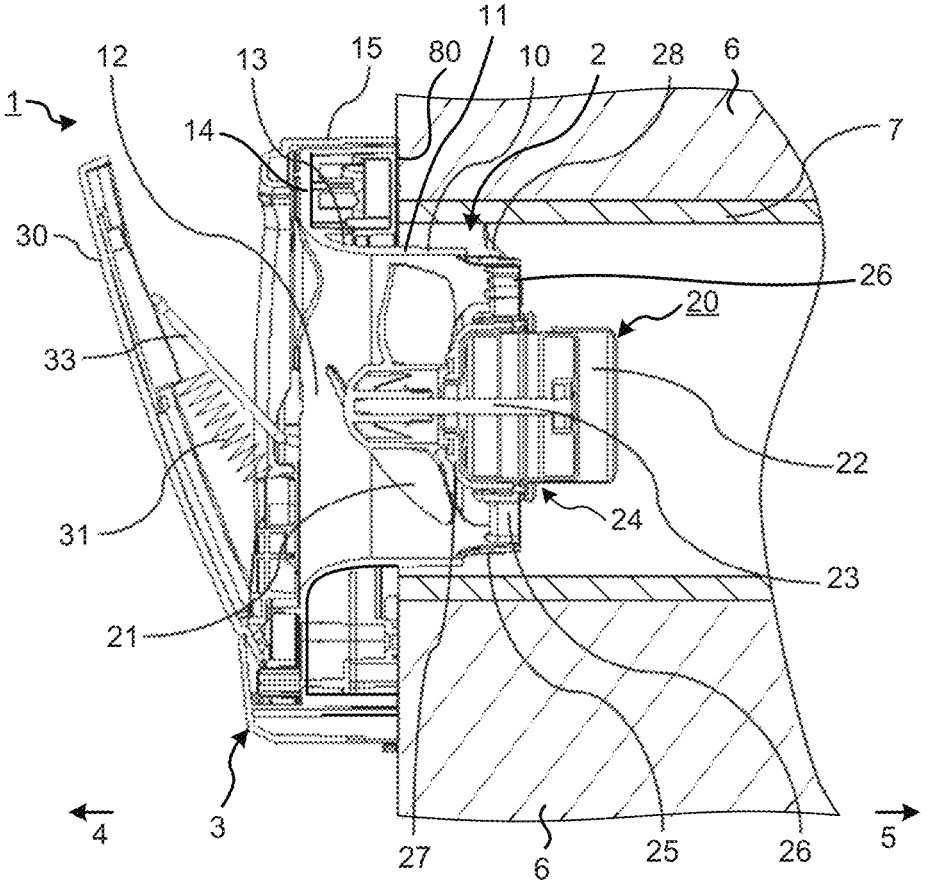
FIG. 1 is a schematic longitudinal sectional view illustrating a ventilation fan according to an embodiment of the present invention as installed in an air passageway.
Figure 2:
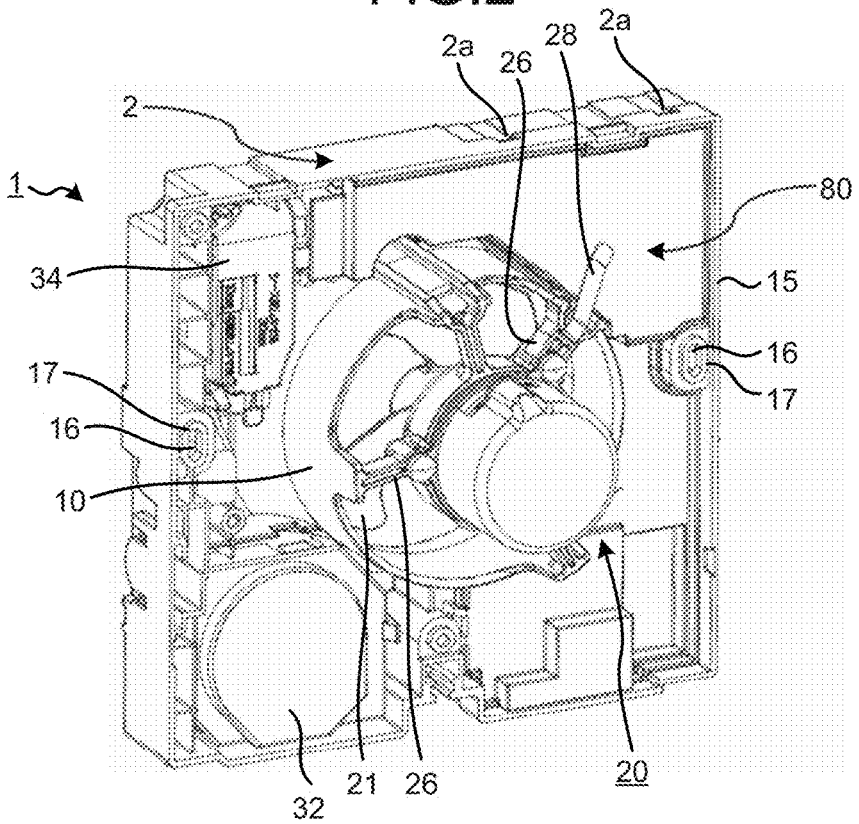
FIG. 2 is a perspective view of the ventilation fan according to the embodiment of the present invention on an outdoor side.
Figure 3:
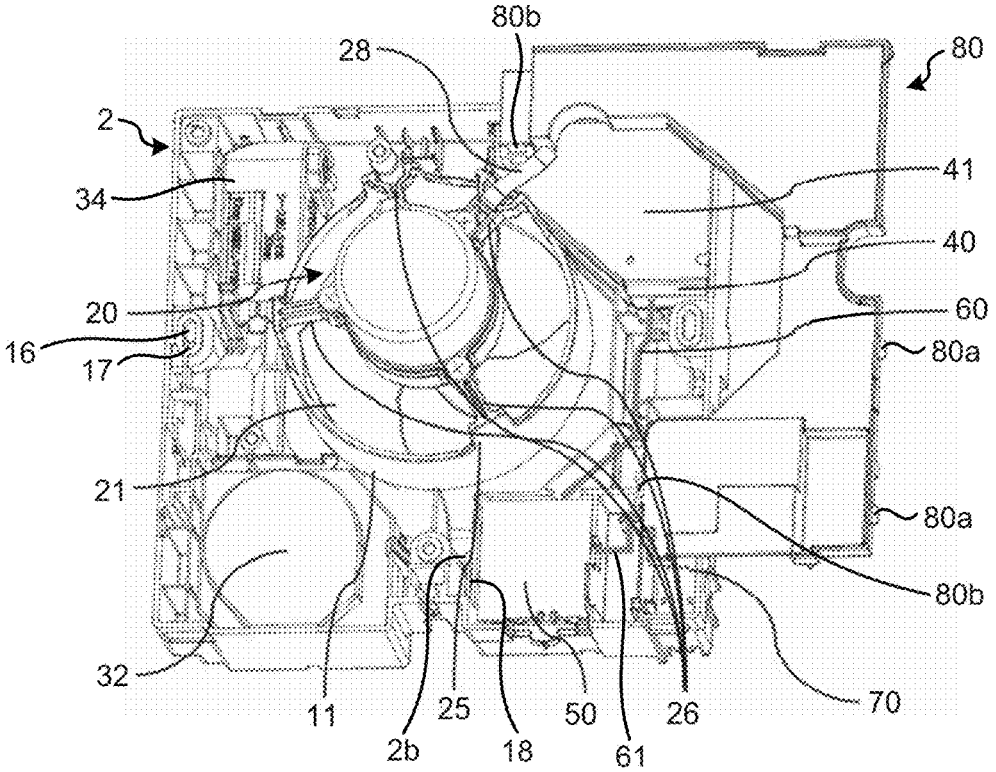
FIG. 3 is an exploded perspective view of the ventilation fan according to the embodiment of the present invention on the outdoor side.

FIG. 1 is a schematic longitudinal sectional view illustrating a ventilation fan 1 according to an embodiment of the present invention as installed in an air passageway 7. FIG. 2 is a perspective view of the ventilation fan 1 according to the embodiment of the present invention on an outdoor side 5. FIG. 3 is an exploded perspective view of the ventilation fan 1 according to the embodiment of the present invention on the outdoor side 5 and is an exploded perspective view illustrating the ventilation fan 1 with a protective cover 80 removed. Note that the relationship between the components in size as illustrated in the drawings may differ from that of actual components.

As illustrated in FIGS. 1 to 3, the ventilation fan 1 according to the present embodiment is installed by inserting it from an indoor side 4 in an attachment location on the indoor side 4 on a wall, a ceiling, or the like of a building. In the present embodiment, the attachment location is on a ceiling 6. The ventilation fan 1 includes a main body 2, which includes a main body frame 10 and a fan 20 attached to the main body frame 10, and a design grille 3. The main body frame 10 is made from resin and includes a cylindrical air channel 11 to be inserted into the air passageway 7, which provides communication between the inside and outside of a room. The design grille 3 is fixed to the main body 2 on the front face side by claw fitting or the like. In the present embodiment, the air passageway 7 is a pipe. In the description below, the left side relative to the drawing plane of FIG. 1 indicates a "front face side" and the right side relative to the drawing plane of FIG. 1 indicates a "back face side".

The main body frame 10 is made from resin and includes the cylindrical air channel 11 that is inserted into the air passageway 7. The air channel 11 has an opening portion 12, which serves as an inlet port to admit air into the air channel 11, on the front face side or the interior side, and a circumferential edge portion 13 of the opening portion 12 of the air channel 11 has a bell-mouth shape. A front face structure is formed as a unit on the circumferential edge portion 13. The front face structure includes a flange 14, which has a square shape and extends from the circumferential edge portion 13 outward in the radial direction of the air channel 11, and a rising portion 15, which rises from the radial-direction outer edge of the flange 14 toward the back face side. The edge surface of the rising portion 15 abuts on the ceiling 6, which is an attachment surface on the interior side, when the ventilation fan 1 is installed inside a room.

The back surface of the main body frame 10 is formed into a recess-like shape by the air channel 11, the circumferential edge portion 13, the flange 14, and the rising portion 15, and components can be accommodated in a region having the recess-like shape. As illustrated in FIGS. 2 and 3, the rising portion 15 includes two attachment portions 17 placed at opposite positions and each having a long hole 16, and the long holes 16 are connected to undepicted attachment holes formed in the front face of the flange 14.

The fan 20 includes a propeller-type impeller 21 and a fan motor 22, which includes a rotation shaft 23 and rotates the impeller 21. The fan 20 is attached to the back face side of the air channel 11 of the main body frame 10.

A fan motor attachment section 24 includes four leg portions 25, which are placed on the back face side of the air channel 11 at intervals in the circumferential direction of the air channel 11 and extend toward the back along the center line direction of the air channel 11; bridge portions 26, which are connected to the end portions of the leg portions 25 so as to extend therefrom inward of the air channel 11 in the radial direction; and a motor cover 27, which is supported by the bridge portions 26 at the center of the air channel 11. The four leg portions 25 are located inward of the outer circumference of the air channel 11 in the radial direction. The fan motor 22 is screwed to the bridge portions 26 such that the rotation shaft 23 extends beyond the edge of the motor cover 27 on the center line of the air channel 11. The impeller 21 is attached to the rotation shaft 23 so as to be surrounded by the air channel 11. When the fan motor 22 is operated to rotate the rotation shaft 23, the impeller 21 is rotated in the air channel 11.

An attachment spring 28 extending outward in the radial direction of the air channel 11 is mounted on one of the bridge portions 26 that is connected to a corresponding one of the four leg portions 25. The attachment spring 28 is curved such that its expanding elasticity in the radial direction retains the main body 2 in the air passageway 7. The attachment spring 28 is used to temporarily fix the main body 2 before the main body 2 is fixed to the attachment portion with wood screws. Although the ventilation fan may be installed with the main body inserted into the air passageway by using the expanding elasticity of the leaf spring and without using any wood screw, it is more common to install the ventilation fan by fixing the main body to the attachment portion with wood screws.

The design grille 3 is configured to cover the flange 14 and the rising portion 15, which form the front face structure of the main body frame 10, from the front face side. The design grille 3 includes a shutter section 30, which opens the air channel 11 when the ventilation fan 1 is being operated and closes the air channel 11 when the ventilation fan 1 is stopped; and a spring 31 for closing the shutter section 30. The design grille 3 is removably attached and fixed to the main body 2 by a fixing method such as claw fitting, and the design grille 3 can thus be cleaned with ease when it is removed.

A rod 33 for opening the shutter section 30 is attached to the main body 2 on the front face side. An electric motor 32 for opening the shutter section 30 is attached to the main body 2 on the back face side. An undepicted wire attached to the electric motor 32 is drawn to the front face side of the main body 2 through an undepicted opening portion disposed in the main body 2. The electric motor 32 can wind the wire or feed the wire to control the motion of the rod 33. The electric motor 32 is actuated with AC power supplied by a control board high-voltage unit 40, which will be described hereinafter. When the power is fed to the electric motor 32, the rod 33 pushes out the shutter section 30 from the outdoor side 5 to the indoor side 4 to open the shutter section 30 and thereby open the air channel 11. When the operation of the ventilation fan 1 is stopped, the shutter section 30 is closed by a reaction force of the spring 31 included in the design grille 3.

A power supply unit 34, which is an electronic component, is accommodated in a region near the upper left corner of the main body 2 at the back surface of the flange 14. The power supply unit 34 supplies AC power that is supplied from an external power supply outside the ventilation fan 1 to the fan motor 22 and the electric motor 32 via an undepicted junction line. The power supply unit 34 is formed from flame-resistant synthetic resin having electrical isolation and includes a connecting terminal for connecting an electric wire of the external power supply. An operation unit connected to the power supply unit 34 and to be operated by a user is placed and exposed from the design grille 3, although detailed description and illustration of it are omitted.

Figure 4:
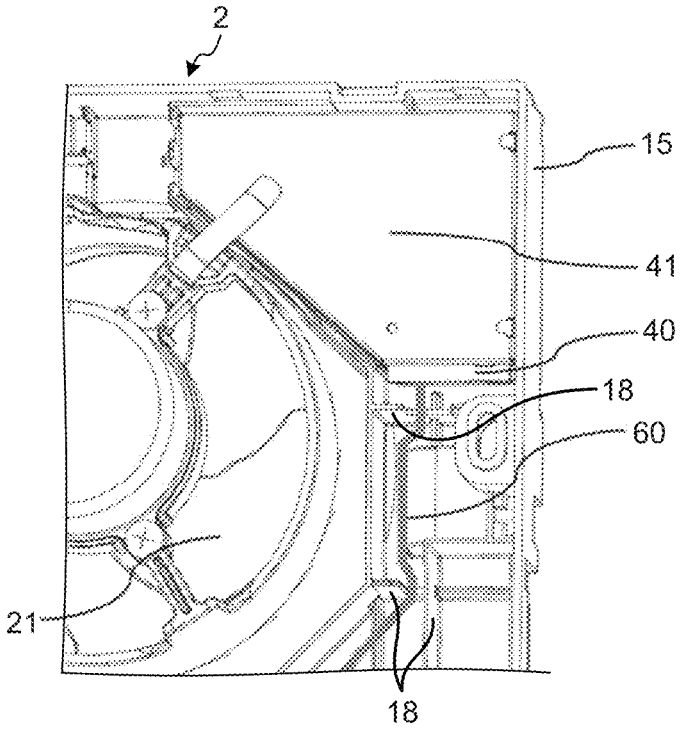
FIG. 4 is a perspective view illustrating a control board high-voltage unit as accommodated in the main body of the ventilation fan according to the embodiment of the present invention.
Figure 5:
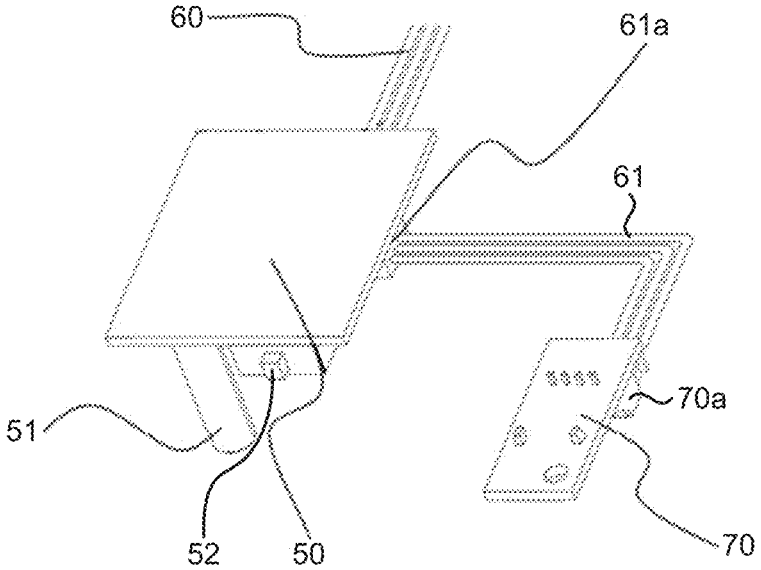
FIG. 5 is a perspective view illustrating a control board low-voltage unit and a sensor of the ventilation fan according to the embodiment of the present invention.
Figure 6:
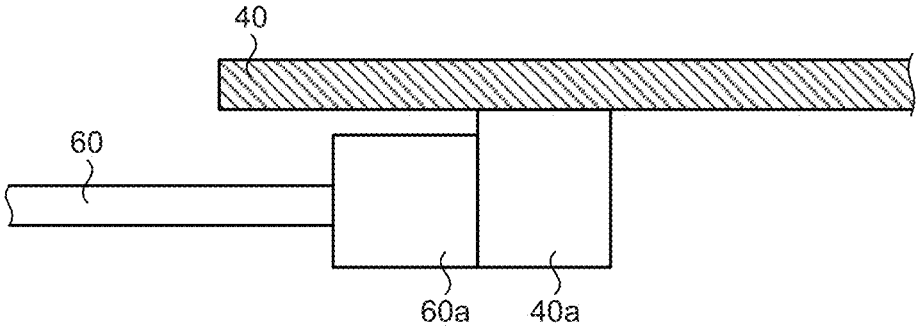
FIG. 6 is a schematic sectional view illustrating the control board high-voltage unit and a junction line as connected to each other in the ventilation fan according to the embodiment of the present invention.
Figure 7:
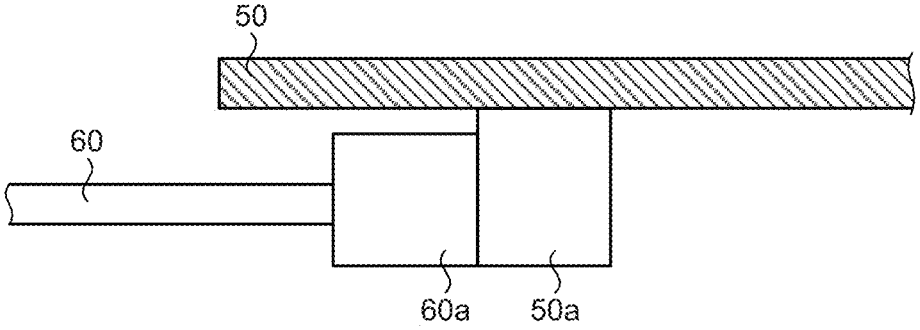
FIG. 7 is a schematic sectional view illustrating the control board low-voltage unit and the junction line as connected to each other in the ventilation fan according to the embodiment of the present invention.
Figure 8:
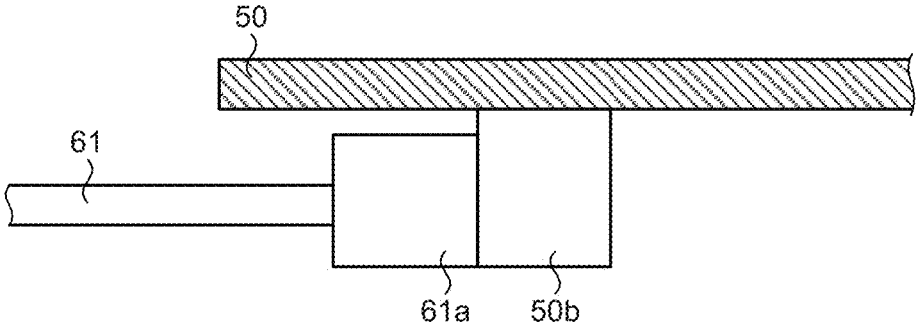
FIG. 8 is a schematic sectional view illustrating the control board low-voltage unit and a junction line as connected to each other in the ventilation fan according to the embodiment of the present invention.
Figure 9:
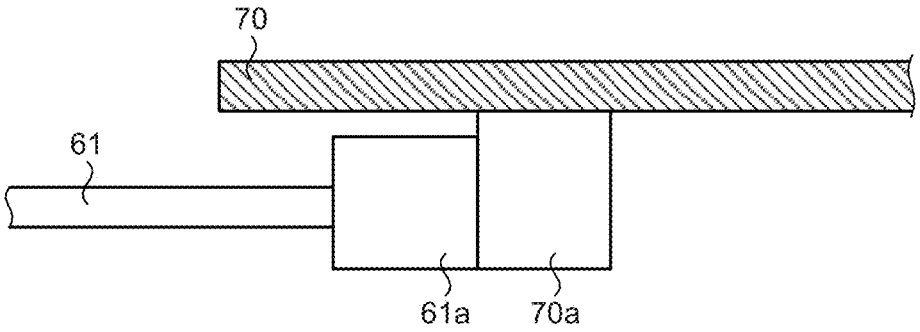
FIG. 9 is a schematic sectional view illustrating the sensor and the junction line as connected to each other in the ventilation fan according to the embodiment of the present invention.

FIG. 4 is a perspective view illustrating the control board high-voltage unit 40 as accommodated in the main body 2 of the ventilation fan 1 according to the embodiment of the present invention. FIG. 5 is a perspective view illustrating a control board low-voltage unit 50 and a sensor 70 of the ventilation fan 1 according to the embodiment of the present invention. FIG. 6 is a schematic sectional view illustrating the control board high-voltage unit 40 and a junction line 60 as connected to each other in the ventilation fan 1 according to the embodiment of the present invention. FIG. 7 is a schematic sectional view illustrating the control board low-voltage unit 50 and the junction line 60 as connected to each other in the ventilation fan 1 according to the embodiment of the present invention. FIG. 8 is a schematic sectional view illustrating the control board low-voltage unit 50 and a junction line 61 as connected to each other in the ventilation fan 1 according to the embodiment of the present invention. FIG. 9 is a schematic sectional view illustrating the sensor 70 and the junction line 61 as connected to each other in the ventilation fan 1 according to the embodiment of the present invention.

The ventilation fan 1 includes the control boards and the sensor 70 for detecting information on the state in a room, which is control determination information to be used in determination for control of the operation of the ventilation fan 1, such as the presence of a person in the room, motion of the person in the room, humidity in the room, temperature in the room, and concentration of a certain gas in the room, and for automatically switching between power on, power off, high power, and low power of the ventilation fan 1 in accordance with the result of the detection. The control boards include the control board high-voltage unit 40 and the control board low-voltage unit 50 illustrated in FIG. 3.

The control board high-voltage unit 40 is a power supply board that is an inverter circuit board that converts AC power supplied from an undepicted external power supply outside the ventilation fan 1 to DC power. The AC power may be supplied from the external power supply to the control board high-voltage unit 40 directly or may be supplied from the external power supply to the control board high-voltage unit 40 via the power supply unit 34. In a case where the AC power is supplied to the control board high-voltage unit 40 from the power supply unit 34, the power supply unit 34 is electrically connected to the control board high-voltage unit 40 via an undepicted junction line.

The control board high-voltage unit 40 is accommodated in a protective case 41 and is covered by the protective case 41 to use. The protective case 41 can protect the control board high-voltage unit 40 from water droplets, dust, and the like and also prevent a short circuit in the control board high-voltage unit 40 from affecting the outside if it occurs. The control board high-voltage unit 40 covered by the protective case 41 is accommodated in a region near the upper right corner of the main body 2 on the back surface of the flange 14.

The control board high-voltage unit 40 is electrically connected to the control board low-voltage unit 50 via the junction line 60, which is a lead wire. The control board high-voltage unit 40 supplies the DC power generated from the AC power to the control board low-voltage unit 50 via the junction line 60. The control board high-voltage unit 40 also supplies the AC power supplied from the external power supply to the electric motor 32. The control board high-voltage unit 40 includes a connector 40*a* for connecting to the junction line 60. The control board low-voltage unit 50 includes a connector 50*a* for connecting to the junction line 60. The junction line 60 includes a connector 60*a* on both ends thereof. By connecting the connector 40*a* and one of the connectors 60*a* together, the control board high-voltage unit 40 is electrically connected to the junction line 60, and by connecting the connector 50*a* and the other one of the connectors 60*a* together, the control board low-voltage unit 50 is electrically connected to the junction line 60. The junction line 60 connected to the connector 40*a* of the control board high-voltage unit 40 is drawn out from the protective case 41 through a cutout portion disposed in one side face of the protective case 41.

The control board low-voltage unit 50 is a control unit that performs control to automatically switch between the power on, the power off, the high power, and the low power of the ventilation fan 1 on the basis of detected data from the sensor 70. The control board low-voltage unit 50 is configured using a circuit board on which a microcomputer is mounted. The control board low-voltage unit 50 is operated on the DC power supplied from the control board high-voltage unit 40 via the junction line 60.

As illustrated in FIG. 3, the control board low-voltage unit 50 is accommodated in the lower portion of the main body 2 on the back surface of the flange 14, which is in a direction that the junction line 60 is drawn out from the control board high-voltage unit 40.

The control board low-voltage unit 50 and the sensor 70 can transmit and receive various types of information to and from each other via the junction line 61. The control board low-voltage unit 50 also supplies a part of the DC power supplied from the control board high-voltage unit 40 via the junction line 60 to the sensor 70 via the junction line 61. The sensor 70 is operated on the DC power supplied from the control board low-voltage unit 50 via the junction line 61.

The control board low-voltage unit 50 includes a setting unit 51 for changing set values of the humidity in the room, the temperature in the room, and the concentration of a certain gas in the room, which serve as threshold values to automatically control the switching of the operation of the ventilation fan 1 on the basis of the result of the detection by the sensor 70. A common variable resistor with a switch is used as the setting unit 51, although detailed description of which is omitted. The control board low-voltage unit 50 calculates the set values of the humidity in the room, the temperature in the room, and the concentration of a certain gas in the room through predetermined arithmetic processing on the basis of the values set by the setting unit 51. The control board low-voltage unit 50 uses the result of this operation as threshold values to automatically switch between the power on, the power off, the high power, and the low power of the ventilation fan 1. The control board low-voltage unit 50 also includes an operation-state switching unit 52 that can change the operation state to any of continuous operation, sensor automatic operation, and power off.

The sensor 70 includes a connector 70*a* for connecting to the junction line 61. The control board low-voltage unit 50 also includes a connector 50*b* for connecting to the junction line 61. The junction line 61 includes a connector 61*a* on both ends thereof. By connecting the connector 70*a* and one of the connectors 61*a* together, the sensor 70 is electrically connected to the junction line 61, and by connecting the connector 50*b* and the other one of the connectors 61*a* together, the control board low-voltage unit 50 is electrically connected to the junction line 61. In this manner, the control board low-voltage unit 50 is electrically connected to the sensor 70 via the junction line 61.

The sensor 70, which detects the motion of a person, the humidity in a room, the temperature in the room, and the concentration of a certain gas in the room, is accommodated in a position on the back surface of the flange 14 at the side of the portion in which the control board low-voltage unit 50 is accommodated. The connector 50*b* is placed on the control board low-voltage unit 50 on a side of a region in which the sensor 70 is located; therefore, the control board low-voltage unit 50 can be connected to the sensor 70 via the junction line 61 having a short length. Thus, the cost of the junction line 61 can be reduced, and the wiring work on the junction line 61 can be performed with ease.

Additionally, the control board high-voltage unit 40, the control board low-voltage unit 50, and the sensor 70 are fixed to the back surface of the flange 14 by the protective cover 80, which covers these components from the back face side, such that these components are isolated from the outside. The junction line 60 and the junction line 61 are also covered by the protective cover 80 such that they are isolated from the outside. A junction line that is used to connect the control board high-voltage unit 40 and the power supply unit 34 together in the case where the AC power is supplied to the control board high-voltage unit 40 from the external power supply via the power supply unit 34 is also covered by the protective cover 80 such that it is isolated from the outside. That is, the protective cover 80 is attached to the back face side of the main body frame 10 so as to cover the electronic components and electrically connected components placed on the back surface of the flange 14 and thereby protect these components. By attaching the protective cover 80 to the back face side of the main body 2, the amount of foreign materials such as water droplets and dust to be adhered to the electronic components and electrically connected components placed in a region covered by the protective cover 80 can be reduced. Additionally, the control boards can be isolated from the outside, and damage to the electronic components and the electrically connected components can be prevented. Furthermore, since the control board high-voltage unit 40, the control board low-voltage unit 50, the sensor 70, and the junction lines 60 and 61 can be covered by the one protective cover 80, effects of standardizing components, reducing the number of components in use, inhibiting die costs, and reducing the assembly work time can be obtained.

As illustrated in FIGS. 2 and 3, the protective cover 80 is attached to the main body 2 by claw fitting in which claw portions 80*a* and hook portions 80*b*, which are placed on the outer circumference of the protective cover 80, are hooked over hook portions 2*a* and claw portions 2*b*, which are placed on the main body 2 side so as to engage with the claw portions 80*a* and the hook portions 80*b*, so that the protective cover 80 is fixed at the back surface of the flange 14. The hook portions 2*a* are disposed on the rising portion 15 of the main body 2. The claw portions 2*b* are disposed on a partition plate 18, which is disposed on the flange 14 and protrudes toward the back face side. At least a part of a flange-14-side surface of the protective cover 80, which is attached to the main body 2, abuts on the control board high-voltage unit 40, the control board low-voltage unit 50, and the sensor 70; therefore, the control board high-voltage unit 40, the control board low-voltage unit 50, and the sensor 70 can be fixed to the back surface of the flange 14 from the back face side.

The protective cover 80, when attached to the main body 2, does not protrude from the edge surface of the rising portion 15. That is, although the back surface of the protective cover 80 has protrusions and recesses, the position of the protective cover 80 attached to the main body 2 on the back face side agrees with the position of the edge surface of the rising portion 15 or is located on the flange 14 side of the edge surface of the rising portion 15 in a perpendicular direction to the flange 14. In this manner, when the ventilation fan 1 is attached to the ceiling 6, the main body frame 10 does not separate from the ceiling 6. Additionally, the position of a portion of the back surface of the protective cover 80 that covers a region in which the junction line 60, which is an electrically connected component, is located on the flange 14 side of a portion of the back surface that covers the control board high-voltage unit 40 and the control board low-voltage unit 50, which are electronic components, in the perpendicular direction to the flange 14.

Figure 10:
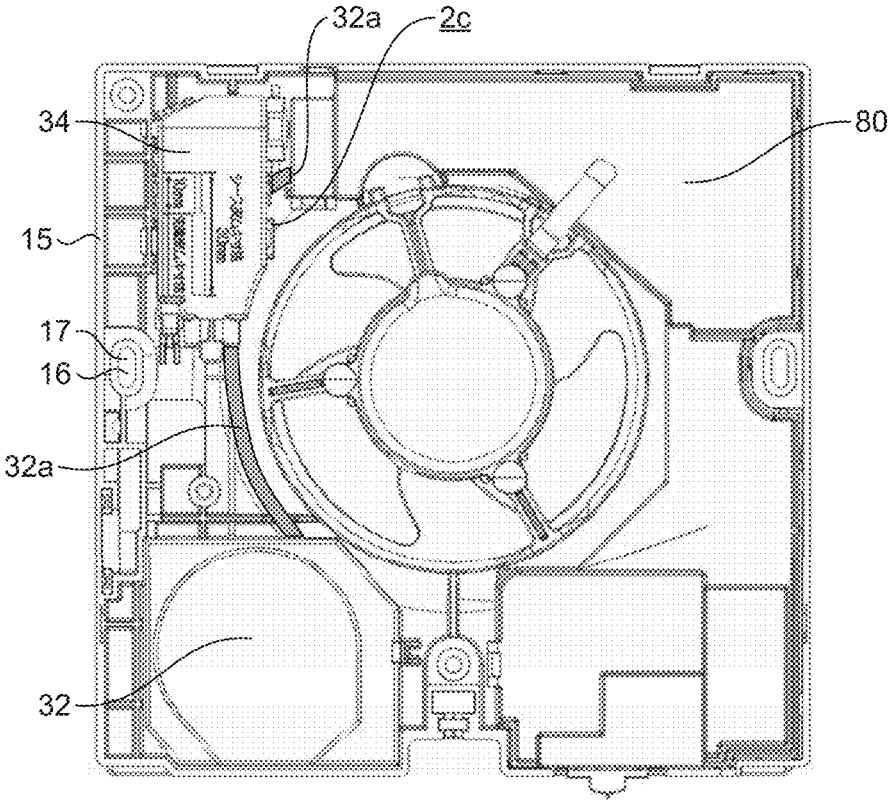
FIG. 10 is a back view of the ventilation fan according to the embodiment of the present invention.

A structure to retain internal wiring in the ventilation fan 1 according to the present embodiment will now be described. FIG. 10 is a back view of the ventilation fan 1 according to the embodiment of the present invention. On the back surface of the flange 14, as illustrated in FIGS. 2, 3, and 10, the electric motor 32 is accommodated in a region near the lower left corner of the main body 2 on the back surface of the flange 14. As described above, the electric motor 32 is accommodated in the region having the recess-like shape formed in the back surface of the main body frame 10 by the air channel 11, the circumferential edge portion 13, the flange 14, and the rising portion 15. The power supply unit 34 is accommodated in the region near the upper left corner of the main body 2 on the back surface of the flange 14.

As illustrated in FIG. 10, the control board high-voltage unit 40, which is covered by the protective cover 80, and the electric motor 32 are connected via an electric wire 32*a*, which is an internal wiring, in the region having the recess-like shape described above on the back surface of the flange 14. The electric wire 32*a* is a junction line for supplying the electric power from the control board high-voltage unit 40 to the electric motor 32 and routed on the back surface of the flange 14. The electric wire 32*a* is omitted in FIGS. 2 and 3.

As illustrated in FIGS. 3 and 4, the control board high-voltage unit 40 is accommodated in the region having the recess-like shape described above near the upper right corner of the main body 2 on the back surface of the flange 14. Hence, as illustrated in FIG. 10, the electric wire 32*a* is placed on the back surface of the flange 14 from the region near the lower left corner of the main body 2 to the region near the upper right corner of the main body 2 in a manner that follows the shape of the curved surface of the air channel 11.

Figure 11:
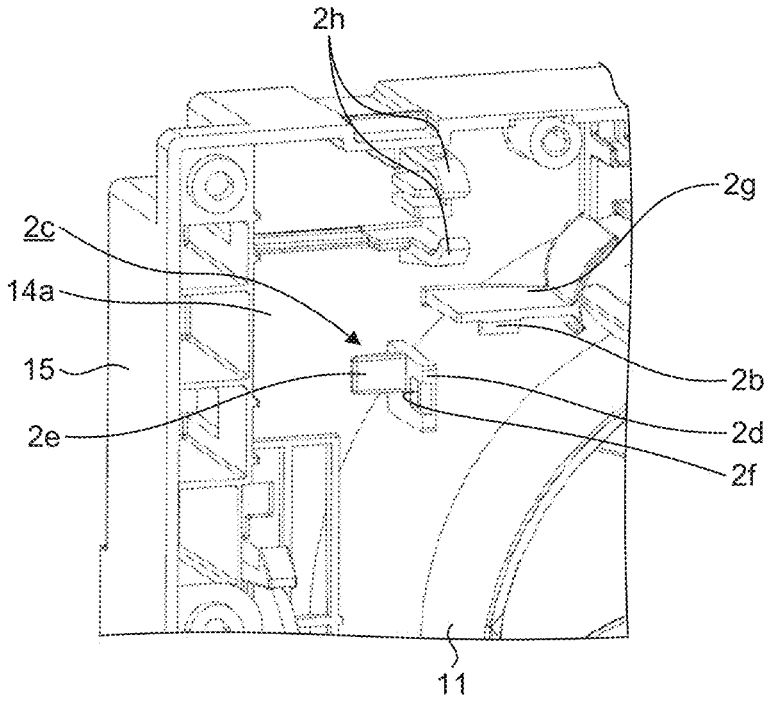
FIG. 11 is a perspective view illustrating a retention portion and a protrusion portion of the ventilation fan according to the embodiment of the present invention.
Figure 12:
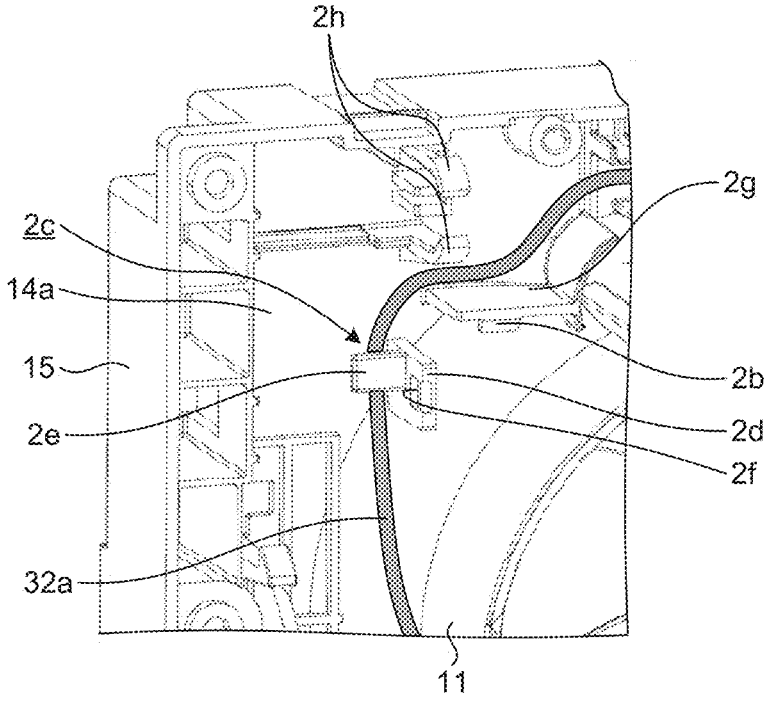
FIG. 12 is a perspective view illustrating an electric wire as retained by the retention portion and the protrusion portion of the ventilation fan according to the embodiment of the present invention.
Figure 13:
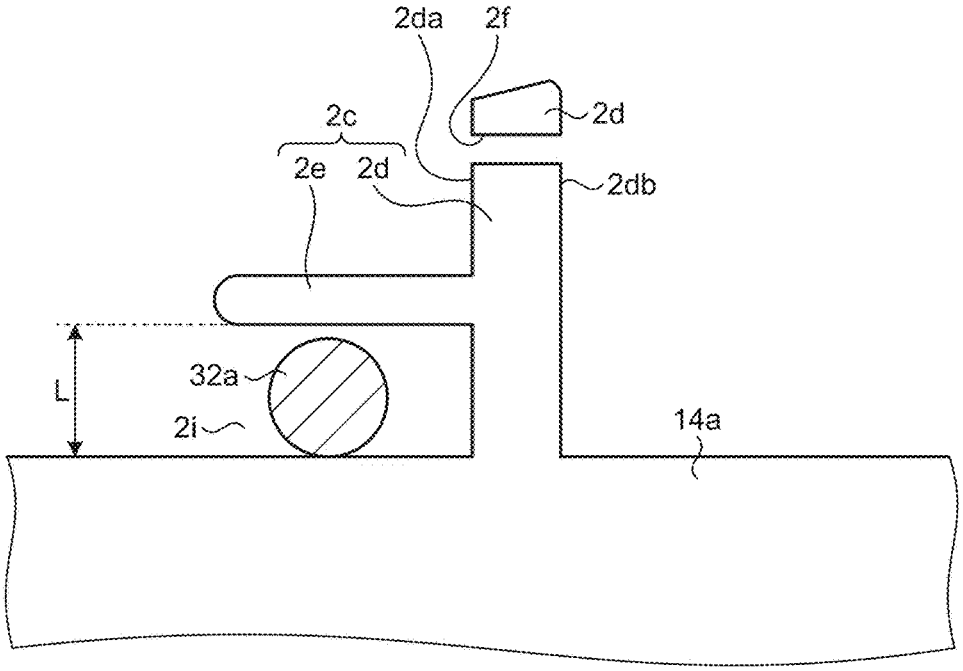
FIG. 13 is a schematic longitudinal sectional view illustrating the electric wire as retained by the retention portion of the ventilation fan according to the embodiment of the present invention.
Figure 14:
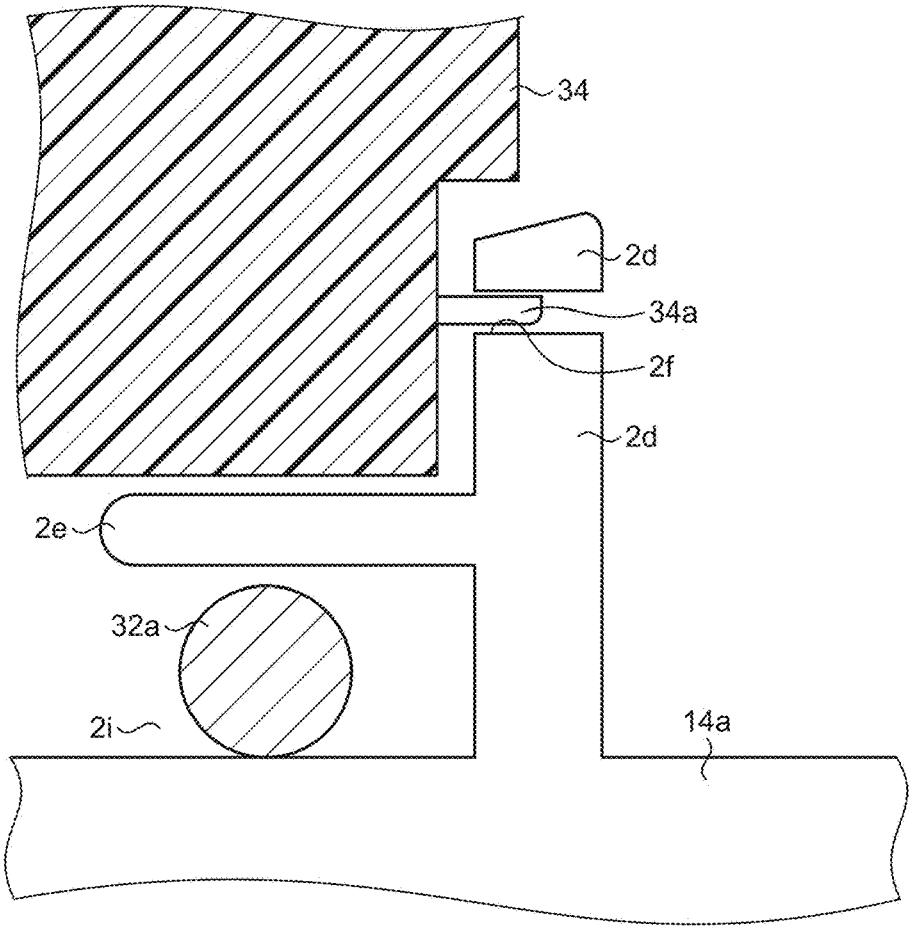
FIG. 14 is a schematic longitudinal sectional view illustrating the electric wire as retained by the retention portion and the power supply unit as attached in the ventilation fan according to the embodiment of the present invention.

FIG. 11 is a perspective view illustrating a retention portion 2*c* and a protrusion portion 2*g* of the ventilation fan 1 according to the embodiment of the present invention. FIG. 12 is a perspective view illustrating the electric wire 32*a* as retained by the retention portion 2*c* and the protrusion portion 2*g* of the ventilation fan 1 according to the embodiment of the present invention. FIG. 13 is a schematic longitudinal sectional view illustrating the electric wire 32*a* as retained by the retention portion 2*c* of the ventilation fan 1 according to the embodiment of the present invention. FIG. 14 is a schematic longitudinal sectional view illustrating the electric wire 32*a* as retained by the retention portion 2*c* and the power supply unit 34 as attached in the ventilation fan 1 according to the embodiment of the present invention.

As illustrated in FIG. 10 and FIGS. 12 to 14, the electric wire 32*a* is retained by the retention portion 2*c*. The retention portion 2*c* is disposed in a region between the region in which the power supply unit 34 is located on a back surface 14*a* of the flange and the air channel 11. As illustrated in FIGS. 11 to 13, the retention portion 2*c* includes a first rib 2*d*, which is disposed in the perpendicular direction to the plane direction of the back surface 14*a* of the flange, and a second rib 2*e*, which is disposed in a horizontal direction to the plane direction of the back surface 14*a* of the flange. As illustrated in FIGS. 13 and 14, the retention portion 2*c* retains the electric wire 32*a* in a retention space 2*i* between the second rib 2*e* and the back surface 14*a* of the flange. The retention portion 2*c* is disposed on the left side of the main body 2 on the back surface of the flange 14 and in a region on the upper side of the attachment portions 17. The retention portion 2*c* is integrally formed with the flange 14 using the same resin as that of the flange 14.

As illustrated in FIG. 13, the first rib 2*d* has four side faces that include a first side face 2*da*, which has a large area, and a second side face 2*db*, which is opposite the first side face 2*da*, and the first side face 2*da* and the second side face 2*db* are parallel with the plane direction of the rising portion 15 on the left side of the main body 2 at the back surface of the flange 14, and have a cuboid shape. The height of the first rib 2*d* is the same as or lower than that of the top face of the power supply unit 34 attached at the back surface of the flange 14. The second rib 2*e* protrudes from the first side face 2*da* of the first rib 2*d* toward the rising portion 15 on the left side of the main body 2 at the back surface of the flange 14.

Since the retention portion 2*c* configured in this manner retains the electric wire 32*a* in the retention space 2*i* between the second rib 2*e* and the back surface 14*a* of the flange, movement of the electric wire 32*a* in the up-and-down direction is restricted and thereby the electric wire 32*a* can be prevented from becoming loose. In this manner, the wiring work can be performed efficiently and smoothly during the assembly of the ventilation fan 1 without the electric wire 32*a* becoming loose. Additionally, the electric wire 32*a* can be prevented from being caught when the cover is attached over a wiring area in which the electric wire 32*a* is disposed. The retention portion 2*c* is integrally formed with the flange 14. Thus, it is not necessary to add a new component to hold the electric wire 32*a* so that the electric wire 32*a* does not become loose or to temporarily fix the electric wire with an adhesive part such as a tape, and thus an increase in manufacturing cost is not caused. In this manner, the ventilation fan 1 lessens the care and management to prevent the electric wire 32*a* from being caught during the assembly of the ventilation fan 1 and alleviates damage to the electric wire 32*a* also in a case where the area in which the electric wire 32*a* is located is covered by the protective cover 80, thereby enabling achievement of a safe structure with good assemblability and at low cost.

By setting the distance L between the undersurface of the second rib 2*e* and the back surface 14*a* of the flange to a minimum required dimension, the electric wire 32*a* can be retained in a manner that does not allow the electric wire 32*a* to be removed easily from between the second rib 2*e* of the retention portion 2*c*, which is parallel with the flange surface, and the flange 14. The minimum required dimension for the distance L between the undersurface of the second rib 2*e* and the back surface 14*a* of the flange is approximately a dimension that allows the electric wire 32*a* to be inserted into and removed from the retention space 2*i* between the second rib 2*e* and the back surface 14*a* of the flange, and it is approximately a dimension larger than the maximum sectional dimension of the electric wire 32*a*. Thus, the distance L between the undersurface of the second rib 2*e* and the back surface 14*a* of the flange is at least the maximum sectional dimension of the electric wire 32*a* in the height direction of the first rib 2*d* when the electric wire 32*a* is retained by the retention portion 2*c*, that is, it is equal to or greater than the maximum dimension of the electric wire 32*a* in a section perpendicular to the longitudinal direction of the electric wire 32*a*. In a case where the electric wire 32*a* is covered by a protective tube, the minimum required dimension for the distance L between the undersurface of the second rib 2*e* and the back surface 14*a* of the flange is approximately a dimension that allows the electric wire 32*a* covered by the protective tube to be inserted into and removed from the retention space 2*i* between the second rib 2*e* and the back surface 14*a* of the flange, and it is approximately a dimension larger than the maximum sectional dimension of the electric wire 32*a* including the protective tube. In the case where the electric wire 32*a* is covered by the protective tube, the distance L between the undersurface of the second rib 2*e* and the back surface 14*a* of the flange is at least the maximum sectional dimension of the electric wire 32*a* including the protective tube in the height direction of the first rib 2*d* when the electric wire 32*a* is retained by the retention portion 2*c*, that is, it is equal to or greater than the maximum dimension of the electric wire 32*a* including the protective tube in a section perpendicular to the longitudinal direction of the electric wire 32*a*. The minimum required dimension for the distance L between the undersurface of the second rib 2*e* and the back surface 14*a* of the flange may be set as appropriate in accordance with conditions such as the sectional dimension of the electric wire 32*a* and how the sectional shape of the electric wire 32*a* is placed when the electric wire 32*a* is retained in the retention space 2*i* between the second rib 2*e* and the back surface 14*a* of the flange. In the case where the shape of the electric wire 32*a* can be changed in a sectional direction, the dimension between the protrusion portion 2*g* and a power-supply-unit retention portion 2*h* may be reduced so as to be smaller than the sectional dimension of the electric wire 32*a*.

The protruding length of the second rib 2*e* from the first side face 2*da* of the first rib 2*d* is preferably at least the maximum sectional dimension of the electric wire 32*a*, that is, it is preferably equal to or greater than the maximum dimension of the electric wire 32*a* in a section perpendicular to the longitudinal direction of the electric wire 32*a*. In the case where the electric wire 32*a* is covered by the protective tube, the protruding length of the second rib 2*e* from the first side face 2*da* of the first rib 2*d* is preferably at least the maximum sectional dimension of the electric wire 32*a* including the protective tube, that is, it is preferably equal to or greater than the maximum dimension of the electric wire 32*a* including the protective tube in a section perpendicular to the longitudinal direction of the electric wire 32*a*. By setting the protruding length of the second rib 2*e* in this manner, the electric wire 32*a* is not removed from the retention space 2*i* between the second rib 2*e* and the back surface 14*a* of the flange easily. As illustrated in FIG. 13, the second rib 2*e* is disposed near the central region of the first rib 2*d* in the height direction of the first rib 2*d*.

As illustrated in FIGS. 11 to 14, an attachment hole 2*f* is placed in the upper region of the first side face 2*da* of the first rib 2*d* in order to attach a claw portion 34*a* placed on the outer portion of the power supply unit 34. When the claw portion 34*a*, which is placed on the outer portion of the power supply unit 34, is inserted into the attachment hole 2*f* of the first rib 2*d*, the claw portion 34*a* catches the edge of the attachment hole 2*f* and is engaged with the attachment hole 2*f*, thereby the first rib 2*d* can retain the power supply unit 34. That is, the retention portion 2*c* has a function to retain the power supply unit 34 in a relatively upper region of the retention portion 2*c* and a function to retain the electric wire 32*a* in a relatively lower region of the retention portion 2*c* in the height direction of the first rib 2*d*.

The power supply unit 34 is not retained only by the engagement between the claw portion 34*a* and the attachment hole 2*f*. The power supply unit 34 is fixed at the back surface of the flange 14 by the engagement between the claw portion 34*a* and the attachment hole 2*f* and by catching of undepicted claw portions placed on the outer portion of the power supply unit 34 in undepicted hook portions placed on the inner surface side of the rising portion 15, so that the power supply unit 34 is attached to the main body 2 by engagement between the claw portions and the hook portions.

The attachment hole 2*f* and the second rib 2*e* can be fabricated by using a die of a slide core scheme without forming an opening hole in a part of the flange 14 on the indoor side 4. Thus, entry of dust and the like from the interior side to the back face side of the flange 14, i.e., to the power supply unit 34 and its periphery, can be inhibited. Additionally, entry of outdoor air from the back face side of the flange 14 to the interior side can be inhibited when the operation of the ventilation fan 1 is stopped. By inhibiting the entry of outdoor air to the interior side, the amount of condensation formed on the surfaces of the design grille 3 and the shutter section 30 when the operation of the ventilation fan 1 is stopped can be reduced even in winter time or the like when the temperature difference between the inside and outside of a building is large. Hence, the ventilation fan 1 can improve outside-air entry resistance and condensation resistance.

The retention portion 2*c* has the function to retain the electric wire 32*a* and the function to retain the power supply unit 34 and a common slide core portion of a die is used for forming the attachment hole 2*f* and the second rib 2*e*; therefore, the die can be produced without increasing the number of slide core portions. That is, by including the attachment hole 2*f* for retaining the power supply unit 34 in the retention portion 2*c*, an increase in cost of production of the die for molding the flange 14 from resin due to an increase in the number of the slide core portions can be inhibited in fabrication of the function to retain the electric wire 32*a* and the function to retain the power supply unit 34 in the back surface 14*a* of the flange by a slide core scheme. By using a protrusion portion needed for the attachment hole 2*f* for fixing the power supply unit 34 as the first rib 2*d* and placing the second rib 2*e* on the first rib 2*d*, an increase in complexity of the structure of the back surface 14*a* of the flange can be inhibited and an increase in cost of production of the die for molding the flange 14 from resin can be inhibited.

In a case where the attachment hole 2*f* and the second rib 2*e* are produced without using a die of a slide core scheme, the second rib 2*e* may protrude in the form of a plate having heights reducing from the first side face 2*da* of the first rib 2*d* toward the back surface 14*a* of the flange. In this case, the distance between the free end of the second rib 2*e*, i.e., the end portion thereof, and the back surface 14*a* of the flange may be set as appropriate to a dimension that can retain the electric wire 32*a* between the undersurface of the second rib 2*e* and the back surface 14*a* of the flange in a manner similar to that described above. In this case, by retaining the electric wire 32*a* between the second rib 2*e* and the back surface 14*a* of the flange, effects similar to those produced when the second rib 2*e* is placed in a direction parallel with the plane direction of the back surface 14*a* of the flange can be also obtained. In the case where the slide core scheme is not used, since an opening portion is needed in a part of the back surface 14*a* of the flange, the effects of improving the outside-air entry resistance and the condensation resistance cannot be obtained, but the electric wire 32*a* can be prevented from becoming loose.

Figure 15:
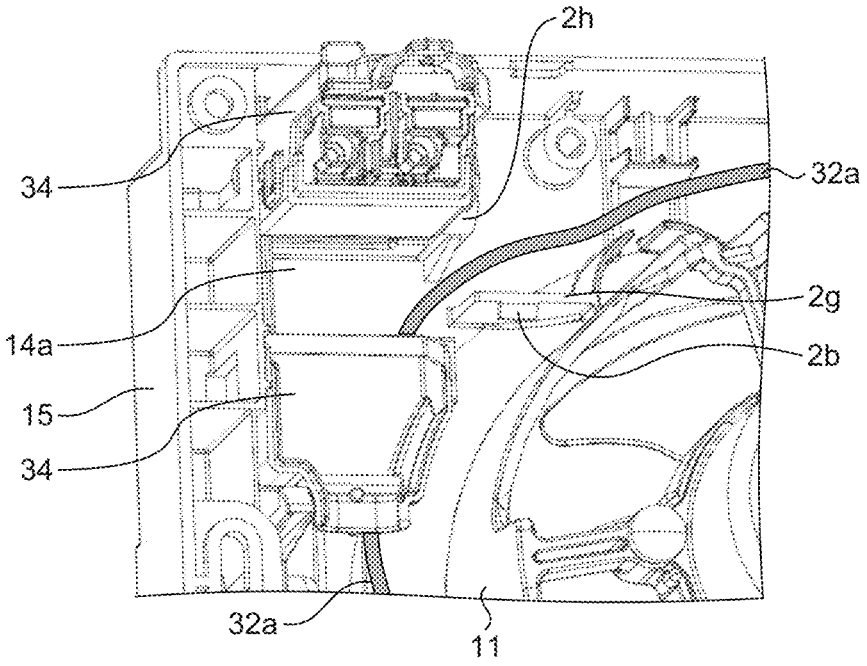
FIG. 15 is a perspective view illustrating the electric wire as retained by the retention portion and the protrusion portion and the power supply unit as attached in the ventilation fan according to the embodiment of the present invention.
Figure 16:
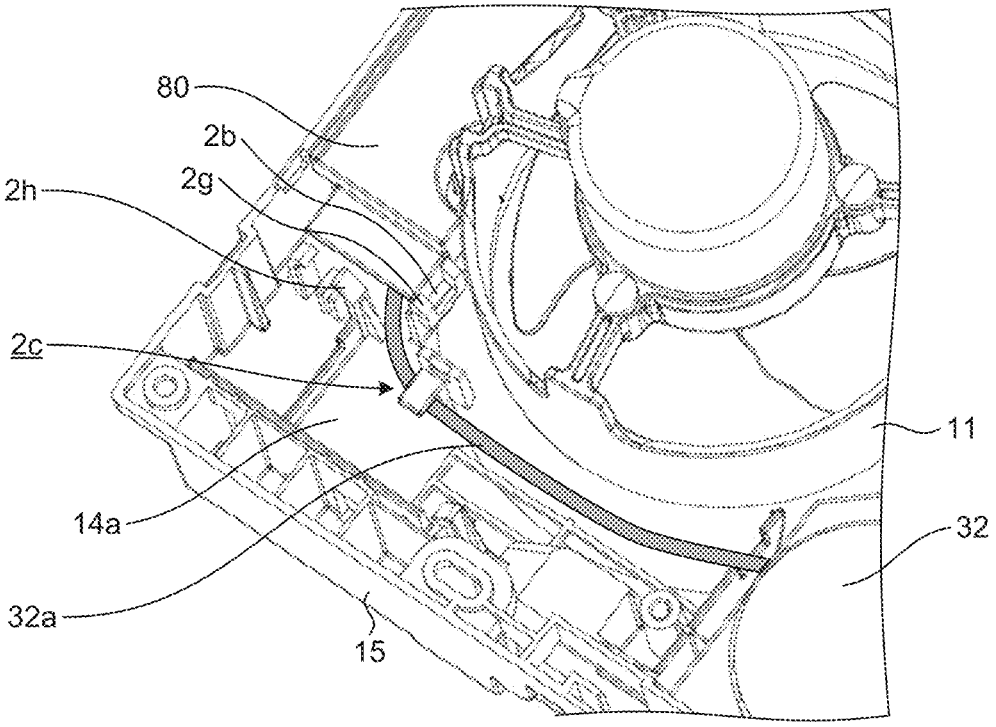
FIG. 16 is a perspective view illustrating the electric wire as retained by the retention portion and the protrusion portion and a protective cover as attached in the ventilation fan according to the embodiment of the present invention.

Additionally, on the back surface 14*a* of the flange 14, as illustrated in FIGS. 11, 12, 15 and 16, the power-supply-unit retention portion 2*h*, which is an electronic-component retention portion that an undepicted hook portion of the power supply unit 34 is attached to, is placed in a region near the region in which the power supply unit 34 is located on the upper side of the main body 2 on the back surface of the flange 14. FIG. 15 is a perspective view illustrating the electric wire 32*a* as retained by the retention portion 2*c* and the protrusion portion 2*g* and the power supply unit 34 as attached in the ventilation fan 1 according to the embodiment of the present invention. FIG. 15 is a perspective view of the outdoor side 5 of the ventilation fan 1 with a part of the power supply unit 34 as fallen down and another part of the power supply unit 34 as standing up. The power supply unit 34 is turnably supported on the main body frame 10 via an undepicted rotation shaft. The power supply unit 34 can fall and stand in the range of 0 degrees to approximately 90 degrees with respect to the back surface 14*a* of the flange. FIG. 16 is a perspective view illustrating the electric wire 32*a* as retained by the retention portion 2*c* and the protrusion portion 2*g* and the protective cover 80 as attached in the ventilation fan 1 according to the embodiment of the present invention. As illustrated in FIGS. 11, 12, 15, and 16, the protrusion portion 2*g* is placed in a peripheral region of the retention portion 2*c* and the power-supply-unit retention portion 2*h*.

The electric wire 32*a*, as drawn out from the electric motor 32 and retained by the retention portion 2*c* and drawn from the retention portion 2*c* out to the upper side of the main body 2 on the back surface of the flange 14, is retained between the protrusion portion 2*g* and the power-supply-unit retention portion 2*h*. By setting the dimension between the protrusion portion 2*g* and the power-supply-unit retention portion 2*h* to the sectional dimension of the electric wire 32*a*, the electric wire 32*a* can be retained between the power-supply-unit retention portion 2*h* and the protrusion portion 2*g* reliably. That is, the protrusion portion 2*g* and the power-supply-unit retention portion 2*h* have the function to retain the electric wire 32*a* and guide the electric wire 32*a* in a direction toward the control board high-voltage unit 40. The dimension between the protrusion portion 2*g* and the power-supply-unit retention portion 2*h* may be set as appropriate in accordance with conditions such as the sectional dimension of the electric wire 32*a* and how the sectional shape of the electric wire 32*a* is placed when the electric wire 32*a* is retained between the protrusion portion 2*g* and the power-supply-unit retention portion 2*h*.

In the case where the shape of the electric wire 32*a* can be changed in a sectional direction, the dimension between the protrusion portion 2*g* and the power-supply-unit retention portion 2*h* may be reduced so as to be smaller than the sectional dimension of the electric wire 32*a*. In this manner, movement of the electric wire 32*a* in the plane direction of the back surface 14*a* of the flange is restricted, and thereby the electric wire 32*a* is guided in the direction toward the control board high-voltage unit 40 reliably. Even in the case where the dimension between the protrusion portion 2*g* and the power-supply-unit retention portion 2*h* is increased so as to be larger than the sectional dimension of the electric wire 32*a*, the movement of the electric wire 32*a* in the plane direction of the back surface 14*a* of the flange can also be restricted.

As illustrated in FIG. 12, the power supply unit 34 is attached to the retention portion 2*c* after the electric wire 32*a* is retained by the retention portion 2*c* and further retained between the power-supply-unit retention portion 2*h* and the protrusion portion 2*g*. In this manner, the electric wire 32*a* is prevented from separating from the retention portion 2*c* more reliably during the assembly of the ventilation fan 1 and thereby damage to the electric wire 32*a* due to the electric wire 32*a* separating from the retention portion 2*c* can be prevented more reliably.

In the ventilation fan 1, AC power may be supplied to the control board high-voltage unit 40 from the external power supply directly without going through the power supply unit 34. In such a case, by setting the dimension between the protrusion portion 2*g* and the power-supply-unit retention portion 2*h* to a minimum required dimension, the electric wire 32*a* can be retained at two locations, namely between the power-supply-unit retention portion 2*h* and the protrusion portion 2*g* and by the retention portion 2*c*; thus, effects similar to those produced in the case of a model including the power supply unit 34, which is attached to the retention portion 2*c*, can be expected.

As illustrated FIGS. 11, 12, 15, and 16, the claw portion 2*b* for attaching one of the hook portions 80*b* of the protective cover 80 is placed on the side face of the protrusion portion 2*g*. In this manner, a structure is provided in which the protective cover 80 is not removed easily at a timing such as in a distribution process from plant shipping to an installation site after the protective cover 80 is attached to the back surface of the main body 2. By attaching the protective cover 80 to the back face side of the main body 2, it is possible to reduce the amount of foreign materials such as water droplets and dust to be adhered to the electronic components and electrically connected components placed in the region covered by the protective cover 80. Additionally, the electronic components and the electrically connected components placed in the region covered by the protective cover 80 are isolated from outside, and damage to the electric wire 32*a* can be prevented without performing a procedure to attach a protective material such as a damage-preventing tube to the electric wire 32*a* in the wiring area. That is, the ventilation fan 1 can lessen the number of protective materials such as a protective tube to be used for the electric wire 32*a* and the amount of used protective material, enabling a reduction in cost. Additionally, the ventilation fan 1 can reduce the work to attach protective materials, enabling improvement in assemblability and work efficiency. Thus, the ventilation fan 1 facilitates the assembly work, and a ventilation fan that prevents damage to the electric wire 32*a* and thus is safer can be achieved with reduced manufacturing costs.

Additionally, it is possible to form a wiring retention portion that is configured by the first rib 2*d*, which is placed in the perpendicular direction to the plane direction of the back surface 14*a* of the flange, and the second rib 2*e*, which is placed in a direction parallel with the plane direction of the back surface 14*a* of the flange, and has the function to retain internal wiring between the second rib 2*e* and the back surface 14*a* of the flange as described above without giving it the function to retain an electronic component. In this case, movement of the internal wiring in the up-and-down direction is restricted and thereby the internal wiring can be also prevented from becoming loose as in the case where the retention portion 2*c* is provided.

In this manner, the wiring work can be performed efficiently and smoothly during the assembly of the ventilation fan 1 without the internal wiring becoming loose. Additionally, the internal wiring can be prevented from being caught when the cover is attached over a wiring area in which the internal wiring is disposed. By forming the wiring retention portion integrally with the flange 14, it is not necessary to add a new component to hold the internal wiring such that the internal wiring does not become loose or to temporarily fix the electric wire with an adhesive part such as a tape, and thus an increase in manufacturing cost is not caused. Such a wiring retention portion can be used for any wiring, instead of the electric wire 32*a*, to be placed on the back surface 14*a* of the flange in the ventilation fan 1.

As described above, the ventilation fan 1 according to the present embodiment includes the retention portion 2*c* on the back surface 14*a* of the flange and thereby can retain an electric wire on the back surface of the flange and prevent the electric wire from becoming loose with a simple structure; thus, the ventilation fan 1 can prevent the electric wire from becoming loose during the assembly of the ventilation fan 1. Hence, the ventilation fan 1 according to the present embodiment eliminates the need to add a new component to hold the electric wire 32*a* or the work to hold the electric wire 32*a*. The ventilation fan 1 can lessen the care and management to prevent the electric wire 32*a* from being caught and alleviate damage to the electric wire 32*a* also in a case where the area in which the electric wire 32*a* is located is covered by the protective cover 80.

Thus, the ventilation fan 1 according to the present embodiment facilitates the assembly work, and a ventilation fan that prevents damage to the electric wire 32*a* and thus is safer can be achieved with a simple structure and with reduced manufacturing costs.

Note that the configurations described in the foregoing embodiments are examples of the present invention; combining the present invention with other publicly known techniques is possible, and partial omissions and modifications are possible without departing from the spirit of the present invention.

REFERENCE SIGNS LIST

1 ventilation fan, 2 main body, 2*a*, 80*b* hook portion, 2*b*, 80*a* claw portion, 2*c* retention portion, 2*d* first rib, 2*da* first side surface, 2*db* second side face, 2*e* second rib, 2*f* attachment hole, 2*g* protrusion portion, 2*h* power-supply-unit retention portion, 2*i* retention space, 3 design grille, 4 indoor side, 5 outdoor side, 6 ceiling, 7 air passageway, 10 main body frame, 11 air channel, 12 opening portion, 13 circumferential edge portion, 14 flange, 15 rising portion, 16 long hole, 17 attachment portion, 18 partition plate, 20 fan, 21 impeller, 22 fan motor, 23 rotation axis, 24 fan motor attachment section, 25 leg portion, 26 bridge portion, 27 motor cover, 28 attachment spring, 30 shutter section, 31 spring, 32 electric motor, 32*a* electric wire, 33 rod, 34 power supply unit, 34*a* claw portion, 40 control board high-voltage unit, 40*a* connector, 41 protective case, 50 control board low-voltage unit, 50*a* connector, 50*b* connector, 51 setting unit, 52 operation-state switching unit, 60 junction line, 60*a* connector, 61 junction line, 61*a* connector, 70 sensor, 70*a* connector, 80 protective cover.

The invention claimed is:

1. A ventilation fan that is attached to an attachment portion in a room and comprises:

a main body frame that includes a cylindrical air channel, a flange connected to a circumferential edge portion of an inlet port of the air channel at a front face side of the air channel and extending in a radial direction, and a rising portion connected to an edge of the flange and protruding toward a back face side; and a fan including an impeller that rotates in the air channel, the ventilation fan comprising:

a first electronic component and a second electronic component that are attached to a back surface of the flange;

a third electronic component that includes a claw portion on an outer portion of the third electronic component and is attached to the back surface of the flange;

an internal wiring routed on the back surface of the flange and connecting the first electronic component and the second electronic component;

a retention portion that includes a first rib protruding from the back surface of the flange in a perpendicular direction to a plane direction of the back surface of the flange, and a second rib protruding from a side face of the first rib in a direction parallel with the plane direction of the back surface of the flange or protruding toward the back surface of the flange, the retention portion retaining the internal wiring between an undersurface of the second rib and the back surface of the flange;

an electronic-component retention portion protruding from the back surface of the flange on a back face side to retain the third electronic component; and a protrusion portion protruding from the back surface of the flange on the back face side in a position facing the retention portion on the back surface of the flange, wherein the retention portion has an attachment hole for attaching the claw portion in an upper region of the first rib with respect to the second rib, the claw portion is inserted into the attachment hole to retain the third electronic component, and the internal wiring is retained between the electronic-component retention portion and the protrusion portion.

2. The ventilation fan according to claim 1, wherein the retention portion is integrally formed with the back surface of the flange.

3. The ventilation fan according to claim 1, further comprising a protective cover attached to the main body frame on the back face side and covering the internal wiring from the back face side.

4. The ventilation fan according to claim 1, further comprising a shutter section that opens the air channel when the ventilation fan is operated and closes the air channel when the ventilation fan is stopped, wherein the first electronic component is an electric motor that controls opening and closing of the shutter section, the second electronic component is a power supply board that supplies, to the electric motor, AC power to be supplied, and the third electronic component is a power supply unit that supplies, to the power supply board, AC power supplied from an external power supply.

* * * * *